US005233808A

United States Patent [19]

Salmenmäki et al.

[11] Patent Number: 5,233,808

[45] Date of Patent: Aug. 10, 1993

[54] METHOD OF CONSTRUCTING A BUILDING

[75] Inventors: Jarmo Salmenmäki, Turku; Jarmo Wacker, Kaarina, both of Finland

[73] Assignee: Masa-Yards Oy, Helsinki, Finland

[21] Appl. No.: 763,995

[22] Filed: Sep. 23, 1991

Related U.S. Application Data

[63] Continuation of Ser. No. 715,440, Jun. 14, 1991, abandoned.

[30] Foreign Application Priority Data

Jun. 19, 1990 [FI] Finland ..... 903074

[51] Int. Cl.[5] ..... E04B 1/348

[52] U.S. Cl. ..... 52/745.02; 52/79.12; 52/79.14; 52/234; 52/236.5

[58] Field of Search ..... 52/741, 79.7, 79.12, 52/79.8, 79.14, 234, 236.3, 239, 79.1, 236.5, 34, 35

[56] References Cited

U.S. PATENT DOCUMENTS 3,256,652 6/1966 van der Lely .
3,514,910 6/1970 Comm ..... 52/79
3,553,391 10/1968 Morrow et al. .
3,623,296 11/1971 Santoro .
3,638,380 2/1972 Perri ..... 52/236
3,712,008 1/1973 Georgiev et al. .
4,766,708 8/1988 Sing .
4,779,552 10/1988 Harsia et al. .

FOREIGN PATENT DOCUMENTS 0360585 3/1990 European Pat. Off. .
2219202 10/1973 Fed. Rep. of Germany .
2719953 7/1978 Fed. Rep. of Germany .
1265925 5/1960 France .
1372468 5/1963 France .
0465190 12/1968 Switzerland .

*Primary Examiner*—Carl D. Friedman
*Assistant Examiner*—Matthew E. Leno
*Attorney, Agent, or Firm*—Dellett, Smith-Hill and Walters

[57] ABSTRACT

The interior of a building having a framework composed of vertical structural elements and horizontal floor levels is constructed by installing prefabricated room units, each having walls and a ceiling, in the framework. The room units are sized and positioned so that a sound insulating air gap is formed between the ceiling of each room unit and the building framework.

20 Claims, 2 Drawing Sheets

METHOD OF CONSTRUCTING A BUILDING

CROSS-REFERENCE TO RELATED APPLICATION

This is a continuation of co-pending patent application Ser. No. 07/715,440 filed Jun. 14, 1991, now abandoned.

BACKGROUND OF THE INVENTION

It is conventional to construct a building by first constructing a self-supporting framework or body of vertical construction elements, such as columns and/or walls, horizontal beams supported by the vertical construction elements, and horizontal floor levels supported by the beams, and then constructing rooms within the framework. The framework may be made predominantly of concrete, particularly steel-reinforced concrete. The framework may alternatively be a steel/-concrete framework, composed of steel columns and beams and concrete floor levels.

Using modern building techniques, the framework of a building can be built relatively rapidly, mostly by using prefabricated supporting building elements. In contrast, construction of the rooms within the framework involves a large amount of manual labor and is therefore expensive and time consuming. Further, it is difficult to organize construction of the interior of a building at the building site because workers of different trades have different tasks to perform and the proper timing of these tasks demands accurate planning and keeping of time schedules.

A conventional building comprising a self-supporting framework and rooms constructed within the framework may suffer from considerable sound insulation problems. Noise is easily transmitted through the framework from one room to another as so called frame sound, and this takes place horizontally from one room to another on the same floor as well as vertically from one room to another on different floors. The sound insulation qualities of the building can be improved by using expensive special measures, for instance by building so called floating floors, or by making the walls and the floor levels thicker than required by the load stresses. Otherwise, it is necessary simply to tolerate the poor sound insulation.

SUMMARY OF THE INVENTION

The object of the invention is to solve several problems relating to construction of buildings. The most important aims are to reduce the time used for interior construction, to allow a large part of the interior construction to be performed away from the construction site, and to provide superior sound insulation qualities. The invention also contributes to an improvement in the fire safety of the building.

The invention is mainly based on the fact that the actual room spaces and their interior are built as prefabricated room units, and that air gaps are provided between the room units and the framework of the building, which provides a considerably improved sound insulation. By selection and placement of appropriate room units, the building may be provided with bedrooms, dining rooms and living rooms at planned locations and special purpose rooms such as kitchen, sauna, bathroom and toilet at planned locations.

The use of room units is known per se in the shipbuilding industry, for instance for the installation of passenger cabins. This art is shown for example in the patent specifications FI 62647, GB 1,600,110 and U.S. Pat. No. 3,363,597. Also in land-based buildings prefabricated room units have been used earlier as shown in the patent specifications U.S. Pat. No. 3,638,380 and U.S. Pat. No. 3,823,520. The known art discloses that a frame of columns and beams has been built to hold the room units in place, so the room units themselves form the building rather than being used for creating the interior of a completed building framework composed of vertical elements, horizontal beams and floor levels. Patent specification U.S. Pat. No. 2,499,498 shows a structure for temporary storage of movable room units and does not disclose a technique for finishing the interior of a building.

The building method according to the invention will considerably speed up the construction of, for instance, a hotel building. It has been calculated that the construction time of a hotel complex having about one hundred rooms can be shortened by as much as five months by using the method according to the invention. At the same time a very high quality level in the interior of the building can be achieved and sound insulation problems can be solved much more easily than in a conventional building.

In a building constructed according to the present invention the frame sounds can pass from room to room only through the floor. Therefore, a considerable improvement in sound insulation will be achieved. Today it is required that the sound insulation between rooms should be at least 52 dB. In order to achieve this value the insulation of intermediate walls in a conventional concrete frame building must be about 60 dB, whereas in a building built according to the invention it is sufficient that the total sound insulation in an intermediate wall structure is about 53 dB. Because of this great difference considerable savings can be made already in the amount of building material used.

The invention can best be applied to a so called column-beam-building. In such a building, the main supporting elements are vertical columns and horizontal beams supported by the columns. The horizontal beams support a bearing floor level, which can take up conventional loads occurring on a floor level. Further, the outer wall or another vertical wall structure of the building may form a part of the building's supporting framework. Then the floor level of the building is an open space including only some supporting columns, into which space room units according to the invention can advantageously be installed.

According to the invention an air gap will be provided also between two adjacent room units in order to achieve a good sound insulation. The best sound insulation is achieved if the heaviest portion of the wall structure at both sides of the air slot are as far as possible from each other. A light insulation material may thus be located close to the air slot and heavy building material, for instance plaster board, tile or brick panels, as far as possible from the air gap. A proper width for the air gap is 40–100 mm, preferably 50–80 mm. A wider air gap usually gives a better sound insulation, but in order to avoid waste of space the air gaps should be no wider than necessary to achieve the desired level of sound insulation. In order to prevent sound from spreading freely in the network of air gaps, sound dampening closing elements may with advantage be provided in the air gaps. This kind of closing element may, for instance, be a soft mineral wool strip extending across the air gap. The closing element is useful also for improving fire safety, because it acts as an obstacle inhibiting spread of fire or high temperature through the air gap network.

Building costs are usually reduced most effectively by using bottomless room units, so that the floor level of the building forms the floor of the room unit, which floor is then properly finished. If an extremely good sound insulation is needed, it is better to use room units with floors, but the costs are considerably higher.

For space saving it is advantageous to use mainly rectangular room units. Preferably, this basic form is slightly modified, so that, for instance, in some corners of the room unit a beveling or some other recess is made in order to accommodate the building's support columns or the like. Also, suitable space for pipes and cables may be left by modifying the basic rectangular form of the room units. If a room unit includes a bathroom or the like, it is usually advantageous to make space for the pipes and cables close to the bathroom. Since the room height in secondary spaces such as corridors and bathrooms need not necessarily be the same as in primary living spaces, such as bedrooms, it is often advantageous for the ceiling of these secondary spaces, or of either of two adjacent secondary spaces, to be lower than the ceiling of the primary living space so that the ceiling is stepped. Air conditioning ducts or the like may open at such a step, because there is suitable space for them above the lower portion of the ceiling.

An efficient and economical use of the building method according to the invention requires that the room units are dimensioned according to a module system suitable for the building structure. For practical reasons the maximum length of the module is usually about 7 m and the maximum width is about 3.4 m due to transportation factors. In special cases even a width of 4 m might be acceptable. Small rooms, such as WCs, bathrooms or the like, are preferably integrated with larger rooms in room units having module dimensions. In practice this means that a module room unit may be divided into two or more functional spaces. Exceptionally large room units may also be brought to the construction site in parts.

The room units can advantageously be installed in the framework through an open outer wall. A room unit intended for a location close to an outer wall can with advantage be provided beforehand with a building element that will ultimately form a part of the outer wall of the building. Alternatively, building elements can separately be installed to form the outer wall when all the room units of one particular story have been installed on the floor level of that story.

If in a building a great number of rooms mainly of the same kind are required, such as hotel rooms or the like, it is usually of advantage to use two kinds of room units of substantially the same size, of which one is essentially a mirror image of the other. By placing a room unit and its mirror unit always side by side the advantage is obtained that the pipes and cables for both the room units can easily be connected to the same HVAC-shaft passing vertically through the building. Also the length Of the pipes and cables extending to different places in the room unit can be minimized by using this mirror-installation mode.

When applying the building method according to the invention it is of advantage to make the room units so stiff that they are self supporting. Then their transportation to the building site and their installation in the framework at the required location will be easy. The stiffness of the room unit should preferably be so great that the room unit does not need to be separately supported in the building Then the room unit rests on the floor level and need not be attached to the vertical elements of the framework, except possibly to the outer wall in the event that this is part of the framework. The only support given by the building will then be the support of the floor level. The lack of other supports will have a positive effect on sound insulation.

BRIEF DESCRIPTION OF THE DRAWINGS

In the following the invention will be described in greater detail with reference to the accompanying drawings, in which.

DETAILED DESCRIPTION

Figure 1:
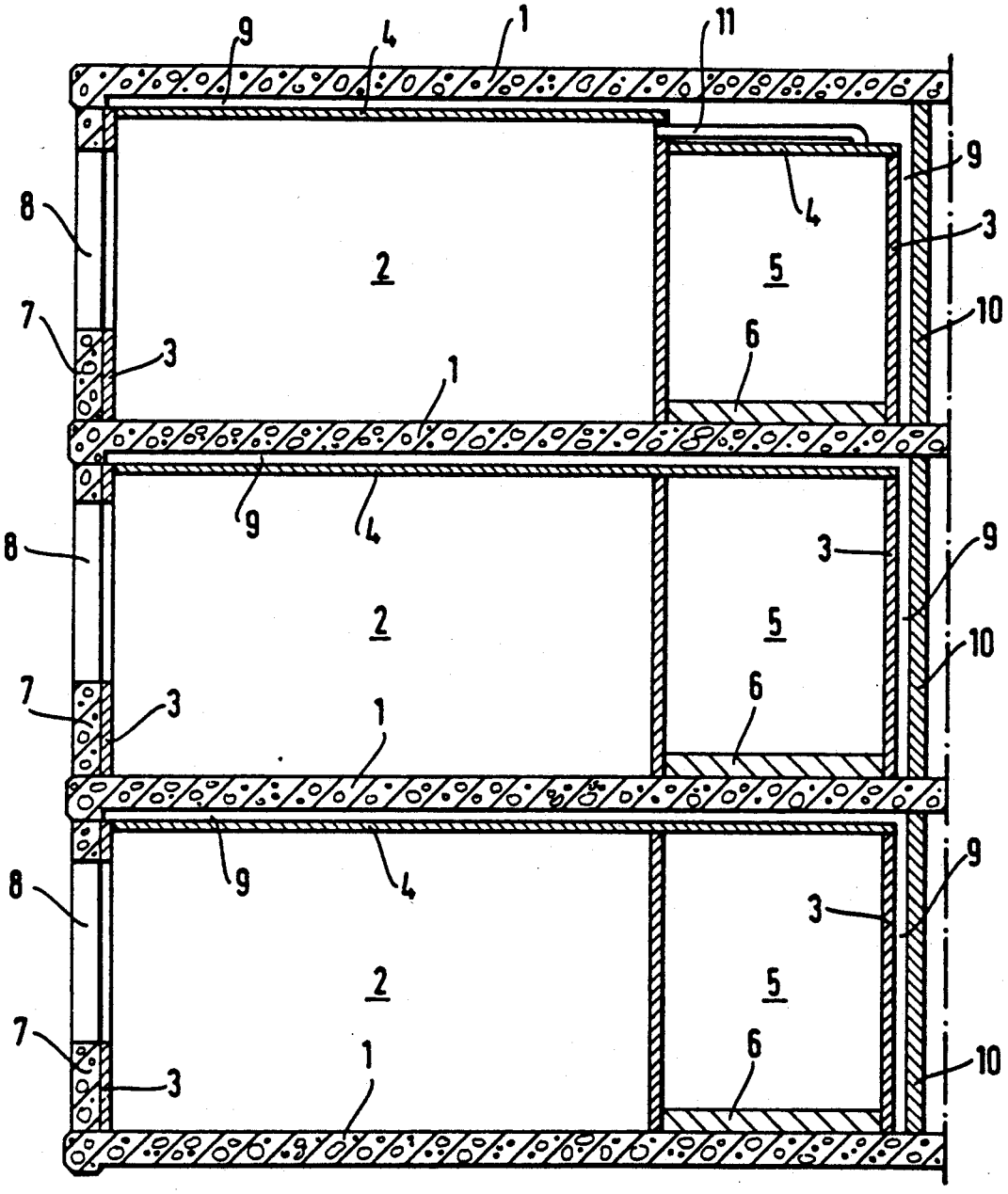
FIG. 1 shows a vertical section of a part of a building constructed according to the method of the invention.
Figure 2:
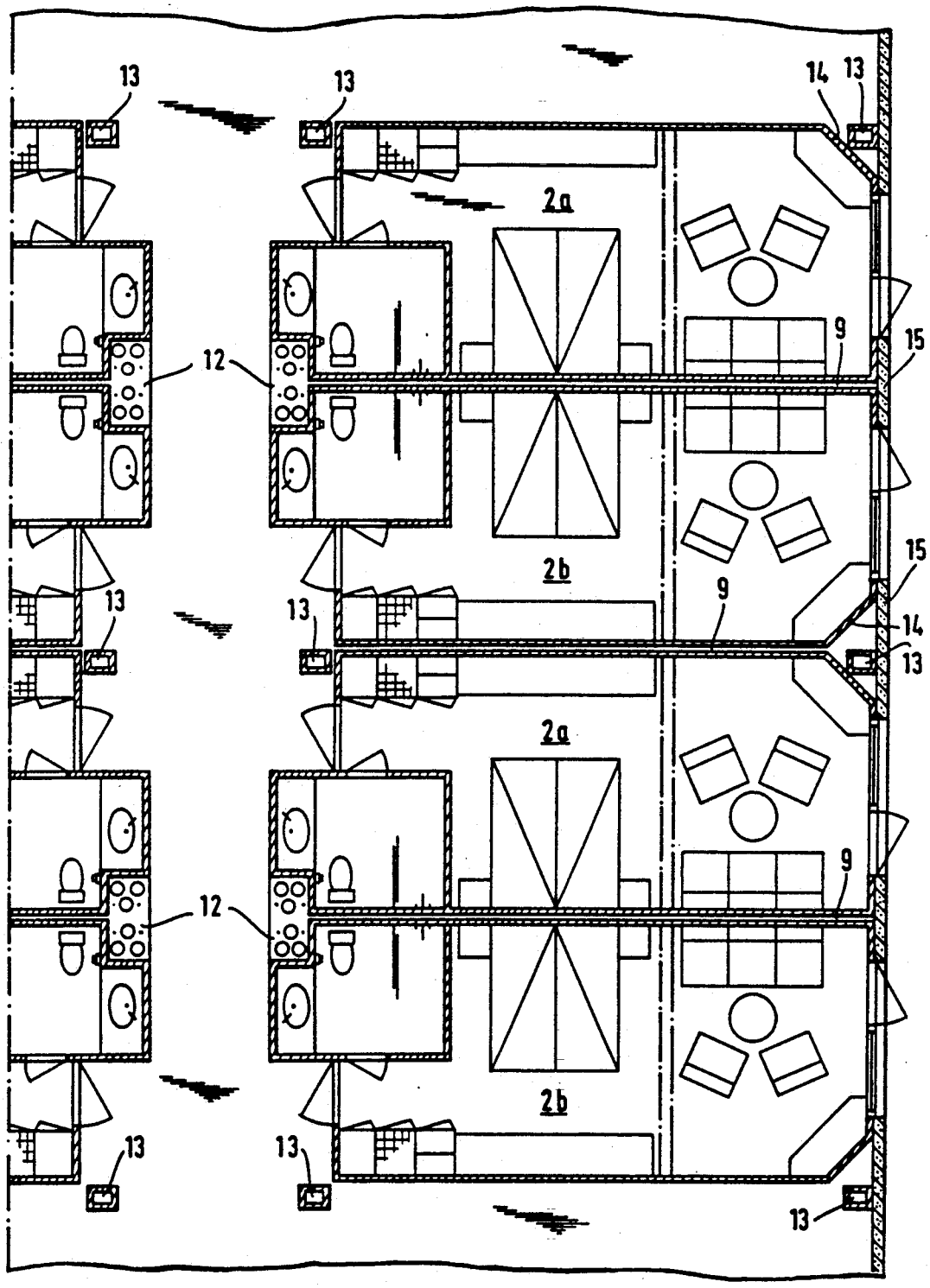
FIG. 2 shows a horizontal section of a part of a floor level of a building.

Referring to FIG. 2 of the framework of a concrete building comprises vertical columns 13 and horizontal beams 16 supported by the columns 13. Floor levels 1 (FIG. 1) are supported on the beams. Between each two vertically adjacent floor levels is shown a prefabricated room unit 2 having walls 3 and a ceiling 4. The room units are bottomless with exception of the wash and WC compartment 5, where a floor 6 has been installed during manufacture of the room unit. The floor 6 of the wash and WC compartment 5 is shown in FIG. 1 only schematically. It is usually somewhat above the average level of the finished floor on its level of the building and is provided with a drain including sewer pipes and with other required equipment, for instance floor warming means.

The outer wall of the building consists partly of outer wall elements 7 associated with the room units 2 respectively. Each outer wall element may include a window 8, a balcony door or other facilities serving the building. The outer wall element 7 may be connected to the room unit 2 during manufacture, or alternatively it may be installed in the framework after the installation of the unit 2.

Between the room unit and adjacent building elements there is an air gap 9, which is provided for sound insulation. If, as shown in FIG. 1, there is a corridor or similar public space adjacent an interior wall of the room unit, a thin panel wall 10 may be installed between the room unit and the corridor with an air gap 9 between the panel wall 10 and the adjacent wall of the room unit.

Usually there is a small entrance area or vestibule at one end of the room unit and beside it the wash and WC compartment 5 as shown in FIG. 1. In this portion of the room unit the ceiling may be somewhat lower than in the main area of the room unit, which is advantageous because the difference in ceiling height may, as shown in FIG. 1, be used for instance to accommodate air conditioning ducts 11 that serve the room unit and open into the room unit at the vertical surface joining the two ceiling portions.

In FIG. 2 is shown how, for instance, the interior of an entire hotel floor may be formed according to the method of the invention using two room unit models **2*a* and 2*b*, which are essentially mirror images of each other. When placing mirror image room units one adjacent to the other, the advantage is obtained that the pipes to be connected to the wash and WC compartments 5, which have been integrated into the room units in the manufacturing phase, may be located in the same utility shaft 12**, which may also accommodate air conditioning ducts, electric cables etc.

The building framework includes support columns 13 and there is room for two room units between two adjacent support columns. If the room units were rectangular in plan, apart from the projection that accommodates the hand basin, adjacent unit by an air gap whose width is equal to the width of the column. However, by providing the room units with a corner beveling 14, so dimensioned that the column 13 may be located in the space provided by the beveling, the advantage is obtained that the width of the air gap can be substantially less than the width of the column and the area available may be used to practically hundred per cent. Because there is normally room for two room units between two support columns 13, there is also the advantage that the corner beveling always faces a support column when the room units are placed in mirror image pairs.

The room units are placed so that the the room unit 2*a* is brought in first through the open outer wall, and is moved aside somewhat so that the column 13 is in the corner beveling of that room unit. The mirror image room unit 2*b* is then placed adjacent room unit 2*a*. Between all room units there is an air slot 9. After the installation of the room units, suitable supplemental wall elements 15 are placed in the outer wall in front of the support columns 13 and, if required, also in front of the gap between a pair of room units.

Normally a room unit is manufactured so that the walls and ceilings are made of bent steel sheets, usually about 0.7–1.0 mm thick. A mineral wool layer is glued to one side of the steel sheet. A continuous layer of, e.g., glass-fiber tissue or cloth, paper, plastic or aluminum foil, or a composite layer of two or more of these materials, may be glued to the mineral wool layer at its surface opposite the steel sheet. The mineral wool layer is usually about 15 mm thick, but it may be considerably thicker if required. The density of the mineral wool is preferably greater than 200 kg/m$^3$. The metal surface side of the wall structure is towards the inside of the room unit and the mineral wool insulation is towards the air gap between the room units. This type of wall construction, in combination with the air gap, is very effective in providing good sound insulation between the interior of the room unit and the framework of the building and, hence, between the interior of a room unit and the interiors of the other room units.

If the sound insulation of the wall structure is to be improved, this may most conveniently be done by including heavy building material, such as plaster board, Dutch tile or the like, in the wall structure. The sound insulating effect of such material is maximized by placing it as far as possible from the air gap. If tiles or the like are not used, the side of the steel sheet which faces the inside of the room unit may be covered with suitable surface material, such as textile, plastic or the like.

Light contact between the room unit and the framework over a limited area, such as might be provided between the columns 13 and a layer of mineral wool on the exterior of the beveling 14 as shown in FIG. 2, is not objectionable because it does not impair significantly the sound insulation qualities that are achieved by avoiding firm mechanical connections.

The invention is not limited to the embodiments described, but several variations and modifications thereof are feasible within the scope of the attached claims. For example, although not shown an air gap may be provided between the room unit and the outer wall of the building, particularly if the outer wall is part of the framework or is installed after the room unit, for insulation against traffic noise.

We claim:

1. A method for creating the interior of a building having a framework made of concrete or of steel/concrete and including load bearing horizontal floor levels, said method comprising installing prefabricated room units, each having walls and a ceiling, in the framework, positioning the room units in the framework so that outside at least some of the walls and/or the ceiling of each room unit an air gap is formed between the room unit and the framework, which air gap in cooperation with adjacent structural parts of the room unit forms a sound insulation with respect to any adjacent portion of the framework, and installing outer wall elements, whereby the building is enclosed at its exterior.

2. A method according to claim 1, comprising installing two room units on a floor level without any portion of the framework therebetween, and positioning the room units close together but with an air gap therebetween in order to provide an effective sound insulation.

3. A method according to claim 1, comprising installing a room unit that is at least partly floorless so that it rests on a selected floor level of the framework and a portion of said selected floor level is exposed in the room unit and constitutes the floor of the room unit, and thereafter applying a floor covering to said portion of the selected floor level.

4. A method according to claim 1, comprising installing room units that are substantially rectangular in plan and each having at at least one corner of the rectangle, a recess, for instance in the form of a beveling, in order to leave space for receiving bearing columns or like components of the building.

5. A method according to claim 1, wherein the room units are dimensioned to fit a module system, for instance whereby the room units are of substantially equal dimensions and the width of a room unit is substantially an integral submultiple of the corresponding horizontal dimension of the building, and a room smaller than the basic measure of the module system, for instance a WC compartment or the like, is incorporated into a room unit by prefabrication.

6. A method according to claim 1, comprising installing at the outer wall of the building a room unit provided by prefabrication with a wall element that fits into an opening in the outer wall of the building to form there a portion of the outer wall.

7. A method according to claim 1, wherein adjacent substantially similar room units form a row, and each room unit in the row is substantially a structural mirror image of an adjacent room unit.

8. A method according to claim 1, comprising positioning the room units such that the width of the air gap is 40–100 mm.

9. A method according to claim 1, comprising positioning the room units such that the width of the air gap is 50–80 mm.

10. A method according to claim 1, comprising installing room units that are sufficiently rigid that they need be supported by the building framework only from below.

11. A method according to claim 1, wherein the framework includes vertical columns and by the horizontal beams, and the space between vertically adjacent floor levels is substantially open.

12. A method according to claim 1, comprising installing soft sound insulating closure elements made of sound dampening material in the air gap, whereby the air gap is divided into at least two regions.

13. A method according to claim 1, wherein the ceiling of the room unit has a lower portion and an upper portion meeting at a step and at least one air conditioning duct extends above the lower ceiling portion and opens into the interior of the room unit at the step.

14. A method according to claim 1, wherein the framework includes vertical elements and horizontal beams and the floor levels are supported by the horizontal beams, and the method comprises positioning the room units so that a wall of a room unit is close to a vertical element of the framework but is spaced therefrom by a sufficient distance to provide an air gap which, in cooperation with the wall of the room unit, forms a sound insulation barrier between said vertical element and the interior of the room unit.

15. A method according to claim 1, further comprising connecting the room units to building utilities, including an air conditioning system.

16. A method according to claim 1, comprising installing the room units through respective openings in the outer wall of the building, and installing outer wall elements in said openings for enclosing the building at its exterior.

17. A method according to claim 1, wherein the framework comprises first and second vertical elements at a predetermined distance in a first horizontal direction and a first room unit has a first horizontal dimension that is substantially an integral submultiple of said predetermined distance, and the method comprises positioning the first room unit so that said first horizontal dimension is substantially parallel to said first horizontal direction, inserting the first room unit between said first and second vertical elements by displacing the first room unit in a second horizontal direction that is substantially perpendicular to said first horizontal direction, and placing the first room unit adjacent the first vertical element, whereby at least one additional room unit that is substantially similar to the first room unit can be installed by insertion between the first room unit and the second vertical element.

18. A method according to claim 17, wherein the first room unit incorporates a prefabricated room of which the dimension parallel to said first horizontal dimension of the first room unit is less than said integral submultiple of said predetermined distance.

19. A building having a framework that includes concrete floor levels and prefabricated room units located in the framework and each resting on a concrete floor level, each room unit having an interior space bounded by a ceiling and walls, the ceiling having a structure that damps airborne noise, and the room units being sized and positioned so that there is an air gap between the ceiling of each room unit and the building framework, which air gap, in cooperation with the ceiling of the room units, forms a sound insulation barrier between the building framework and the interior space of the room units, and the building also having outer wall elements that enclose the building at its exterior.

20. A building according to claim 19, wherein the framework is composed of vertical elements, horizontal beams, and floor levels supported by the horizontal beams, the walls of the room units damp airborne noise, and there is an air gap between the walls of a room unit and vertical elements of the framework, which air gap, in cooperation with the walls of the room unit, forms a sound insulation barrier between the building framework and the interior space of the room unit.

* * * * *